US006470837B2

(12) United States Patent
Kayahara et al.

(10) Patent No.: US 6,470,837 B2
(45) Date of Patent: Oct. 29, 2002

(54) METHOD FOR SERVICING AND MAINTAINING HEAT SUPPLY EQUIPMENT

(75) Inventors: Toshihiro Kayahara; Kazuhiro Tachino, both of Matsuyama; Yasuo Watanabe, Hojo, all of (JP)

(73) Assignee: Miura Co., Ltd., Ehime-ken (JP)

( * ) Notice: Subject to any disclaimer, the term of this patent is extended or adjusted under 35 U.S.C. 154(b) by 0 days.

(21) Appl. No.: 09/915,575

(22) Filed: Jul. 27, 2001

(65) Prior Publication Data

US 2002/0011220 A1 Jan. 31, 2002

(30) Foreign Application Priority Data

Jul. 28, 2000 (JP) ..... 2000-228056

(51) Int. Cl.[7] ..... F24D 5/00

(52) U.S. Cl. ..... 122/396; 237/12; 702/182; 702/184

(58) Field of Search ..... 122/396, 447, 122/507; 237/8 A, 8 B, 12; 432/51, 55, 266; 702/182, 184

(56) References Cited

U.S. PATENT DOCUMENTS 4,453,499 A * 6/1984 Palmer ..... 122/396
4,864,972 A * 9/1989 Batey et al. ..... 122/448 B
6,078,649 A * 6/2000 Small et al. ..... 379/39

* cited by examiner

*Primary Examiner*—Gregory Wilson
(74) *Attorney, Agent, or Firm*—Birch, Stewart, Kolasch & Birch, LLP

(57) ABSTRACT

In heat supply equipment provided with a plurality of maintenance object units, secure and prompt servicing and maintenance is implemented and a burden on a person in charge of managing the heat supply equipment is decreased. In a method for servicing and maintaining heat supply equipment based on a servicing and maintenance contract to perform specified servicing and maintenance of a maintenance object unit in heat supply equipment, which includes making a supervisory center for mediating request information from the heat supply equipment communicatable with the heat supply equipment via communication means, while making the supervisory center communicatable with service suppliers who perform the servicing and maintenance via the communication means, the method includes the steps of: receiving request information automatically transmitted from the heat supply equipment in the supervisory center; determining necessary servicing and maintenance works based on the request information received; selecting service suppliers who can perform the servicing and maintenance works; transmitting necessary information from the supervisory center to the service suppliers; and instructing the service suppliers to take measures based on the transmitted information.

2 Claims, 4 Drawing Sheets

METHOD FOR SERVICING AND MAINTAINING HEAT SUPPLY EQUIPMENT

BACKGROUND OF THE INVENTION

The present invention relates to a method for servicing and maintaining heat supply equipment provided with a boiler or the like.

The heat supply equipment is provided with such equipment units as a water treatment unit, a fuel supply unit, and a wastewater treatment unit in addition to the boiler. A cogeneration system, which is one of the heat supply equipment, is provided with such units as an engine, a dynamo, and an exhaust heat recovery boiler. Usually, these units are serviced and maintained by different contractors. Accordingly, when an abnormality occurs in one of the units, a person in charge of managing the heat supply equipment needs to confirm which contractor is responsible for the unit, before making contact for requesting repair works. It takes labor as well as time to confirm the contractor, which elongates the halt period of the unit, resulting in considerable loss in production factories or the like.

The water treatment unit requires proper supply of consumables such as water treatment chemicals to be added to feedwater or salts to be used for a regeneration purpose in water softeners. However, if the person in charge of managing the heat supply equipment neglects supply management, the water treatment unit runs short of the chemicals and the salts, and as a result suffers from inability to function properly, thereby hindering operation of the heat supply equipment. Similarly, in the case of fuel supply of the fuel supply unit, negligence of fuel supply management causes shortage of fuel, which disables operation of the heat supply equipment. In operation of the heat supply equipment, therefore, supply management of the consumables and the fuel is quite important.

SUMMARY OF THE INVENTION

It is an object of the present invention to implement secure and prompt servicing and maintenance in heat supply equipment provided with a plurality of maintenance object units, as well as to decrease a burden on a person in charge of managing the heat supply equipment.

In order to achieve the above object, in a first aspect of the present invention, there is provided a method for servicing and maintaining heat supply equipment based on a servicing and maintenance contract to perform specified servicing and maintenance of a maintenance object unit in heat supply equipment, which includes making a supervisory center for mediating request information from the heat supply equipment communicatable with the heat supply equipment via communication means, while making the supervisory center communicatable with service suppliers who perform the servicing and maintenance works via the communication means, the method comprising the steps of: receiving request information automatically transmitted from the heat supply equipment in the supervisory center; determining necessary servicing and maintenance works based on the request information received; selecting service suppliers who can perform the servicing and maintenance works; transmitting necessary information from the supervisory center to the service suppliers; and instructing the service suppliers to take measures based on the transmitted information.

In a second aspect of the invention, there are provided a plurality of the maintenance object units, and the service suppliers are set for each of the maintenance object units.

Next, embodiments of the present invention are described. Maintenance object units in the heat supply equipment in the present invention include a boiler, a water treatment unit, a fuel supply unit, and a wastewater treatment unit. The boiler includes diverse types of boilers such as steam boilers, hot-water boilers, and heating medium boilers. The maintenance object units also include a unit to supply heat and cold, such as cooling and heating machines. In the case where the heat supply equipment is a cogeneration system, the maintenance object units include an engine, a dynamo, and an exhaust heat recovery boiler.

In implementing servicing and maintenance of the heat supply equipment, first a servicing and maintenance contract is made between an owner of the heat supply equipment or a user thereof (hereinafter referred to as a "contractant") and a maintenance personnel. The servicing and maintenance contract defines that specified servicing and maintenance shall be given to each of the maintenance object units. For fulfilling the contents of the servicing and maintenance contract, the maintenance personnel installs a supervisory center which mediates request information from the heat supply equipment.

The supervisory center and the heat supply equipment can communicate with each other via a communication means. More particularly, a computer of the supervisory center and a computer of the heat supply equipment are linked so as to enable communication thereamong via the communication means. The computer of the heat supply equipment herein refers to either an individual computer of each maintenance object unit or a computer unifying the maintenance object units. The supervisory center can be installed in a remote place away from the heat supply equipment for a specified distance, or installed inside the heat supply equipment or in the vicinity thereof.

In addition, the supervisory center and a service supplier who performs the servicing and maintenance can communicate via a communication means. More particularly, a computer of the supervisory center and a computer of the service supplier are linked so as to enable communication thereamong via the communication means. The service supplier is set to each of the maintenance object units. The service supplier can be either a servicing department of a company to which the supervisory center belongs or can be another company.

Communication is implemented with use of a public telephone line or a dedicated line, which can be wired or wireless.

In the above constitution, once request information is automatically transmitted from the heat supply equipment, the supervisory center receives the request information. Based on the received request information, the supervisory center determines necessary servicing and maintenance works, and selects a service supplier who can perform the servicing and maintenance works. Then, the supervisory center transmits necessary information to the service supplier, and instructs the service supplier to take measures based on the transmitted information.

Determining the servicing and maintenance works and selecting the service supplier can be implemented automatically by the computer of the supervisory center or by a staff member of the supervisory center. In the case of automatic implementation, the computer of the supervisory center can transfer received request information as it is to the service supplier, or can transmit information for instructing to take measures based on the received request information to the service supplier. When the information is transmitted to the service supplier, detailed information necessary for performing servicing and maintenance works is transmitted together.

The request information includes abnormalities recovery request information transmitted when an abnormality occurs in any of the maintenance object units. In addition to the abnormalities recovery request information, the water treatment unit, for example, transmits information for requesting supply of water treatment consumables such as water treatment chemicals to be added to feedwater or salts to be used for a regeneration purpose in water softeners. Upon reception of the information, the supervisory center transfers the information to the service supplier that is, in this case, a water treatment company. The water treatment company dispatches or delivers the water treatment consumables. In the case of receiving information for requesting fuel supply to the fuel supply unit as the request information, the information is transferred to the service supplier that is in this case, a fuel supply company. The fuel supply company incorporates the fuel supply to the fuel supply unit into a tanker delivery schedule. This ensures supply management of water treatment consumables, fuel, and the like, which prevents operation halt of the heat supply equipment, and decreases a burden on a person in charge of managing the heat supply equipment.

Further, according to the above-stated constitution, in the case where a different service supplier is set to each of the maintenance object units like the case of the cogeneration system, the supervisory center can determine the contents of request information from each of the maintenance object units, and can transfer request information to each of the service suppliers. This saves labor of a person in charge of managing the heat supply equipment to confirm a service supplier in charge, and eliminates delay of report, thereby enabling prompt response to request information.

In the case where the service supplier is a company different from the company to which the supervisory center belongs, the supervisory center concludes a information mediation contract with the service supplier, to charge and collect fees on information transmittance to the service supplier. This means that the supervisory center does a business of information mediation.

According to the above constitution, as described above, in the heat supply equipment provided with a plurality of the maintenance object units, secure and prompt servicing and management, as well as considerable decrease in a burden on a person in charge of managing the heat supply equipment are implemented.

In the case where a different service supplier is set to each of the maintenance object units, it is in general necessary to establish a system to receive request information per maintenance object unit. According to the above constitution, however, installing the supervisory center which collectively conducts information mediation makes it possible to simplify the system and to eliminate necessity for the service supplier to own his own system. It can be said, therefore, that the above-stated constitution brings about large advantages to the service supplier too.

DETAILED DESCRIPTION OF THE PREFERRED EMBODIMENTS

Hereinbelow, embodiments of the present invention will be described in details with reference to drawings. In implementing a servicing and maintenance method for a heat supply equipment in the present invention, first a servicing and maintenance contract is made for a consideration between an owner of the heat supply equipment or a user thereof (hereinafter referred to as a "contractant") and a maintenance personnel. The servicing and maintenance contract defines that specified servicing and maintenance shall be given to each of the maintenance object units. More particularly, abnormalities recovery in occurrence of abnormalities and supply of consumables for maintaining functions are included in the contract. For fulfilling the contents of the servicing and maintenance contract, the maintenance personnel installs a supervisory center described later. Different from the maintenance Personnel, there is set a service supplier who actually performs the servicing and maintenance works. An information mediation contract is concluded between the maintenance personnel and the service supplier.

Figure 1:
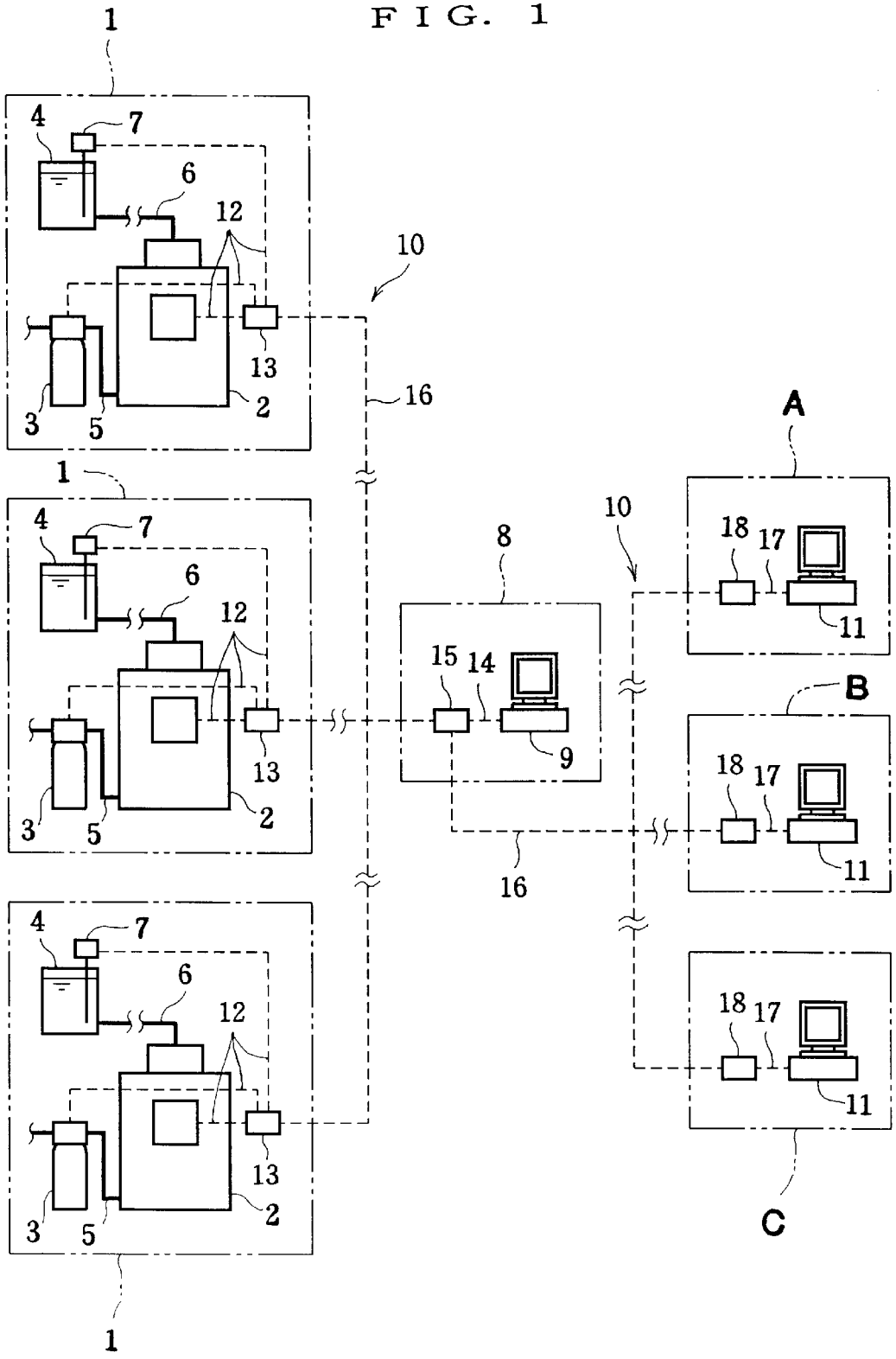
FIG. 1 is a schematic view showing a schematic constitution of a system in the present invention.

Next, a schematic constitution of a system for implementing the invention will be described with reference to (FIG. 1. As shown in FIG. 1, heat supply equipment 1, 1, . . . is each equipped with maintenance object units including boilers 2, 2, . . . water softeners 3, 3, . . . and fuel tanks 4, 4, . . . Each of the water softeners 3 is connected to each of the boilers 2 through feedwater lines 5, 5, . . . Each of the fuel tanks 4 is connected to each of the boilers 2 through fuel lines 6, 6, . . . and provided with Liquid level sensors 7, 7, . . . for detecting a residual quantity of fuel.

In every management area, there is installed a supervisory center 8 for receiving request information from each of the heat supply equipment 1. A first computer 9 is installed in the supervisory center 8. The first computer 9 is connected to each of the boilers 2, each of the water softeners 3, and each of the fuel tanks 4 via a communication means 10 in a communicatable manner. For each of the maintenance object units, there is set a service supplier who performs the servicing and maintenance works based on request information transferred from the supervisory center 8. In an embodiment shown in the drawing, there are set three service suppliers consisting of a first service supplier A, a second service supplier B, and a third service supplier C. For each of these service suppliers A, B and C, there are provided second computers 11, 11 and 11. Each of these second computers 11 is connected to the first computer 9 via the communication means 10 in a communicatable manner.

More particularly, computers (not shown) of each of the boilers 2, each of the water softeners 3, and each of the fuel tanks 4 are each connected to first modems 13, 13, . . . via first signal lines 12, 12, . . . , while the first computer 9 is also connected to a second modem 15 via a second signal line 14. Further, each of the first modems 13 are connected to the second modem 15 via a public telephone line 16. Similarly, each of the second computers 11 is connected to third modems 18, 18 and 18 via third signal lines 17, 17 and 17, and each of the third modems 18 is connected to the second modem 15 via the public telephone line 16. In this embodiment, therefore, the communication means 10 is composed of each of the first modems 13, the second modem 15, each of the third modems 18, and the public telephone line 16.

Figure 2:
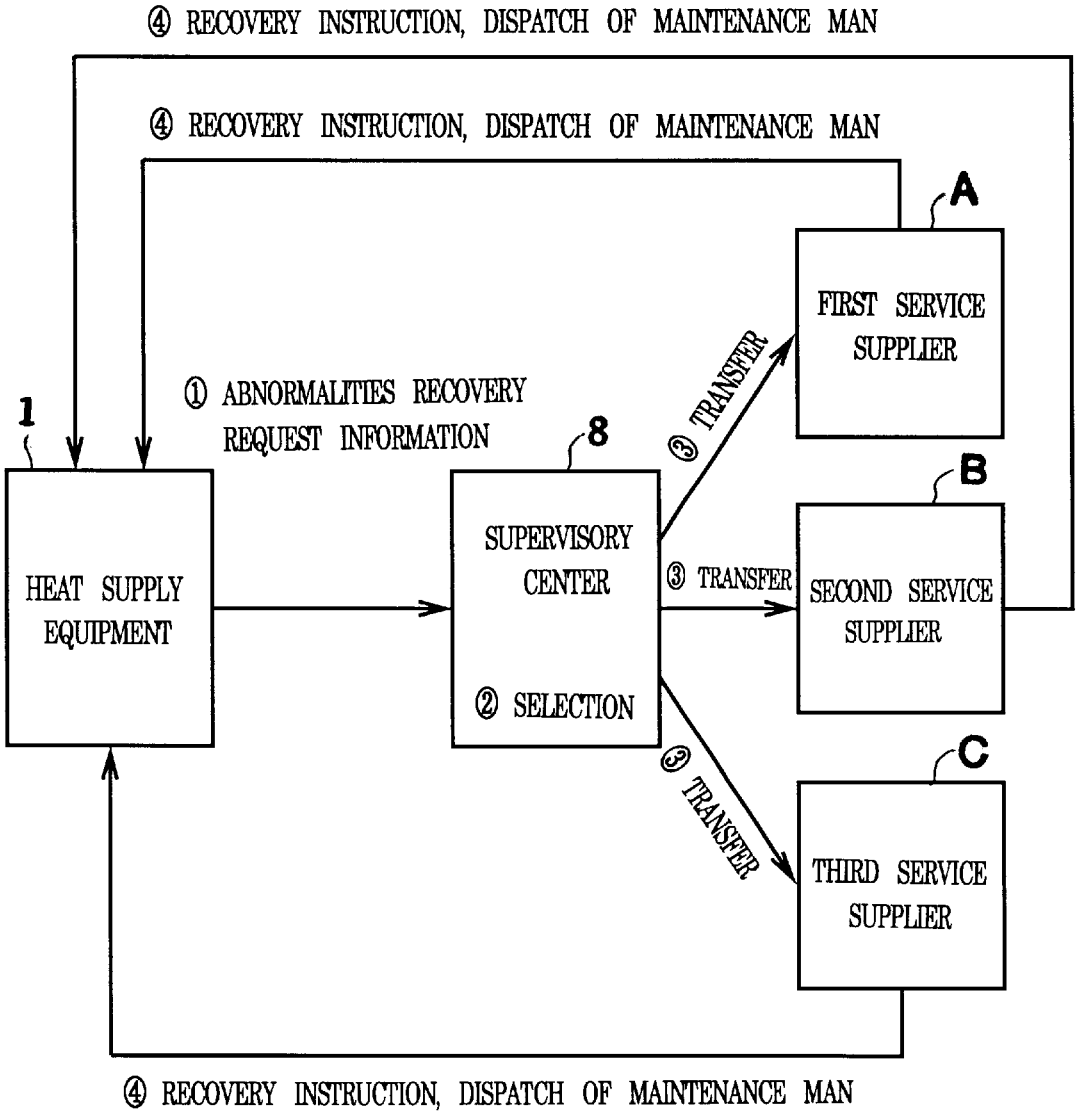
FIG. 2 is a schematic view showing a servicing and maintenance method according to a first embodiment of the present invention.
Figure 3:
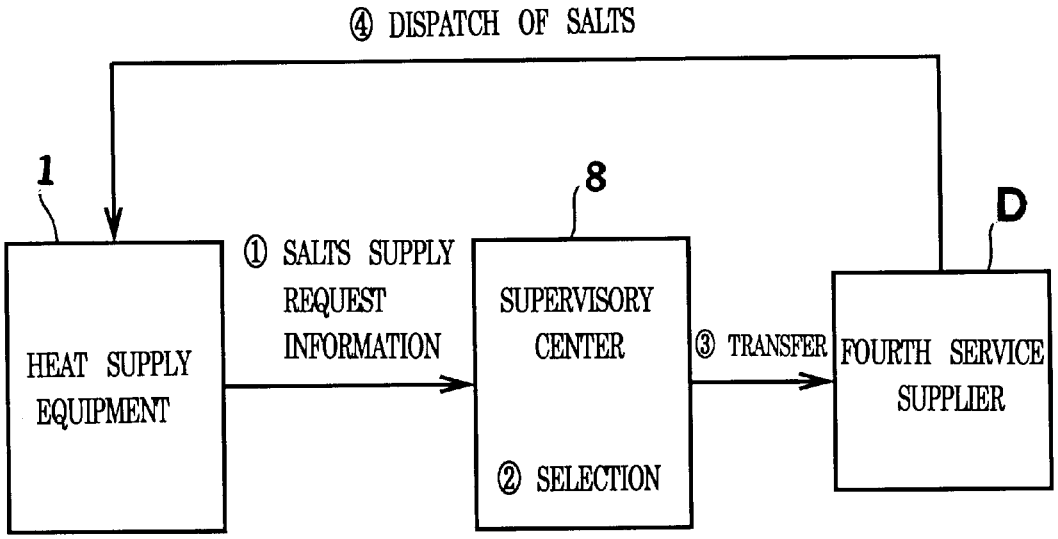
FIG. 3 is a schematic view showing a servicing and maintenance method according to a second embodiment of the present invention.
Figure 4:
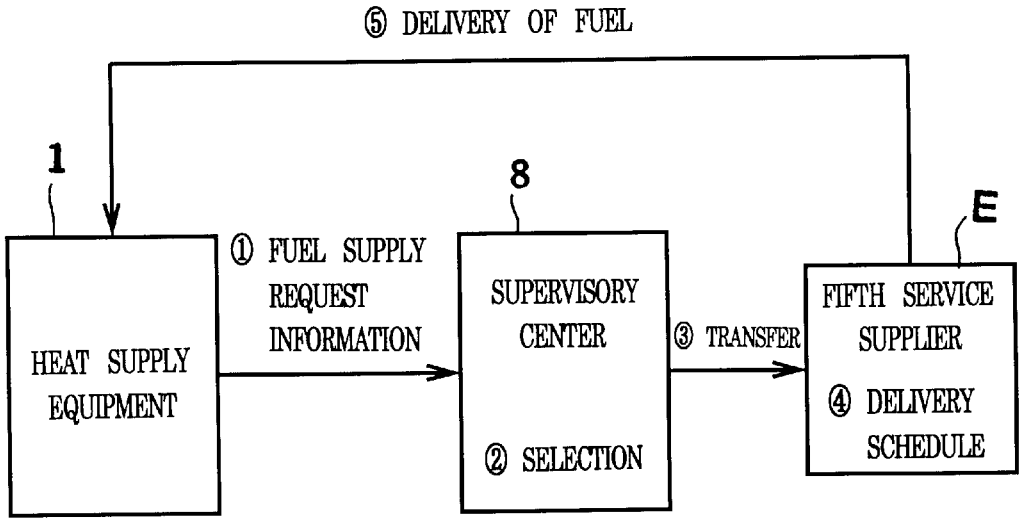
FIG. 4 is a schematic view showing a servicing and maintenance method according to a third embodiment of the present invention.

Next, description will be given of the particular contents of the servicing and maintenance method in the above-stated constitution with reference to FIGS. 2 to 4.

First, description will be given of a servicing and maintenance method in the above constitution according to a first embodiment with reference to FIG. 2. It is noted that given description will be about the case of receiving request information from one of the heat supply equipment 1.

In the first embodiment, the heat supply equipment 1 transmits, as request information, abnormalities recovery request information. When any abnormalities occur in the heat supply equipment 1, information to request recovery from the abnormalities is automatically transmitted to the supervisory center 8, and the supervisory center 8 receives the transmitted abnormalities recovery request information. For example, if a feedwater pump (not shown) of the boiler 2 is in the state of decreased performance, information thereof is transmitted as the abnormalities recovery request information.

Based on the abnormalities recovery request information, the supervisory center 8 determines necessary servicing and maintenance works, and selects the service suppliers A, B and C who can perform the servicing and maintenance works. The selection is automatically conducted by the first computer 9 in the supervisory center 8. For example, in the case of an abnormality in the boiler 2, the first service supplier A is selected. In the case of an abnormality in the water softener 3, the second service supplier B is selected. In the case of an abnormality in the fuel tank 4, the third service supplier C is selected.

To each of the selected service suppliers A, B and C, the abnormalities recovery request information is transmitted from the supervisory center 8. At this point, depending on embodiments, detailed information on the abnormalities recovery request information can be transmitted together. More particularly, upon reception of the abnormalities recovery request information, the supervisory center 8 confirms the contents thereof, and at the same time, requests related detailed information to the heat supply equipment 1 and receives thereof, and then transmits the detailed information to each of the service. suppliers A, B and C. This enables each of the service suppliers A, B and C to perform secure and effective recovery from abnormalities.

Further, upon reception of the transferred abnormalities recovery request information, each of the service suppliers A, B and C analyzes the abnormalities recovery request information and/or the detailed information, and based on the analysis result, dispatches a maintenance man or instructs recovery to a person in charge of managing the heat supply equipment 1. More particularly, the transmitted abnormalities recovery request information and/or the detailed information are displayed on a monitor screen of the second computer 11 in each of the service suppliers A, B and C. Each of the service suppliers A, B and C analyzes the displayed information and takes measure based on the analysis result.

Therefore, it is possible to accurately recognize the current operational state of the heat supply equipment 1, and therefore adequate instruction can be immediately given. In the case where the maintenance man needs to go to a site, he/she can identify the cause of an abnormality and prepare components and the like necessary for repair works in advance, which enables him/her to do repair works immediately after reaching the site.

As stated above, according to the first embodiment, when an abnormality occurs in each of the maintenance object units of the heat supply equipment 1, it is possible to save labor of confirming a proper service supplier in charge among the service suppliers A, B and C, as well as to transmit abnormalities recovery request information without delay. This enables secure and prompt implementation of servicing and maintenance works as well as considerable decrease in a burden on a person in charge of managing the heat supply equipment 1.

Next, description will be given of a servicing and maintenance method in the above constitution according to a second embodiment with reference to FIG. 3. It is noted that given description will be about the case of receiving request information from one of the heat supply equipment 1.

In the second embodiment, there is transmitted, as request information, salts supply request information, that is information for requesting supply of salts used for a regeneration purpose in the water softener 3 of the heat supply equipment 1. More particularly, in the water softener 3, consumed quantity of the salts is integrated whenever regeneration is conducted. When the integrated value reaches a set value, the salts supply request information is automatically transmitted. The transmitted salts supply request information is received by the supervisory center 8.

Based on the salts supply request information, the supervisory center 8 conducts selection of a service supplier who can implement supply of salts, and selects a fourth service supplier D that is a salts supply company. Like the first embodiment, the selection is automatically conducted by the first computer 9 in the supervisory center 8.

The salts supply request information is transferred from the supervisory center 8 to the fourth service supplier D, and the fourth service supplier D dispatches salts to the heat supply equipment 1. Depending on embodiments, it can be arranged such that the fourth service supplier D delivers salts to the heat supply equipment 1 and also conducts operation of adding the salts to a salts tank (not shown) of the water softener 3.

As stated above, according to the second embodiment, labor of salts supply management in the water softener 3 is considerably decreased. In addition, secure salts supply management prevents regeneration failure due to shortage of salts, and enables reliable maintenance of a function of the water softener 3, that is, softening raw water. Further, leakage of hardness components is prevented, which prevents scaling on the boiler 2, resulting in high efficiency kept in the boiler 2 and breakage of a boiler body being prevented.

Description will now be given of a servicing and maintenance method in the above constitution according to a third embodiment with reference to FIG. 4. It is noted that given description will be about the case of receiving request information from one of the heat supply equipment 1.

In the third embodiment, there is transmitted, as request information, fuel supply request information, that is information for requesting supply of fuel to the fuel tank 4 of the heat supply equipment 1. More particularly, in the fuel tank 4, a residual quantity of fuel is detected by the liquid level sensor 7. When the residual quantity reaches a set value, the fuel supply request information is automatically transmitted. The transmitted fuel supply request information is received by the supervisory center 8.

Based on the fuel supply request information, the supervisory center 8 conducts selection of a service supplier who can implement supply of fuel, and selects a fifth service supplier E that is a fuel supply company. Like each of the aforementioned embodiments, the selection is automatically conducted by the first computer 9 in the supervisory center 8.

The fuel supply request information is transferred from the supervisory center 8 to the fifth service supplier E, and the fifth service supplier E estimates supply time based on the residual quantity of fuel and average daily quantity consumed in the boiler 2, incorporates fuel supply into a tanker delivery schedule, and carries out delivery of fuel according to the delivery schedule. Depending on embodiments, it can be arranged such that the supervisory center 8 estimates the supply time and imparts instruction thereof to the fifth service supplier E.

As stated above, according to the third embodiment, labor of fuel supply management in the fuel tank 4 is considerably decreased. In addition, secure fuel supply management promises prevention of operational halt of the boiler 2 due to shortage of fuel, and implements stable supply of steam.

It is noted that the supervisory center 8 mediates information as a business. Accordingly, the maintenance personnel concludes the information mediation contract with each of the service suppliers A, B, . . . , and charges and collects fees on information transmittance to each of the service suppliers A, B, . . . In the servicing and maintenance contract, a specified amount of a contract fee is defined, and it is speculated that when each of the service suppliers A, B, . . . performs dispatch of a maintenance man, supply of salts, supply of fuel, and the like, the contractant pays fees to each of the service suppliers A, B, . . .

According to the present invention, in a heat supply equipment provided with a plurality of maintenance object units, secure and prompt servicing and maintenance is implemented, and a burden on a person in charge of the heat supply equipment can be considerably decreased.

What is claimed is:

1. A method for servicing and maintaining heat supply equipment based on a servicing and maintenance contract to perform specified servicing and maintenance of a maintenance object unit in heat supply equipment (1), which includes making a supervisory center (8) for mediating request information from the heat supply equipment (1) communicatable with the heat supply equipment (1) via communication means (10), while making the supervisory center (8) communicatable with service suppliers (A, B, . . . ) who perform the servicing and maintenance via the communication means (10), the method comprising the steps of: receiving request information automatically transmitted from the heat supply equipment (1) in the supervisory center (8); determining necessary servicing and maintenance works based on the request information received; selecting service suppliers (A, B, . . . ) who can perform the servicing and maintenance works; transmitting necessary information from the supervisory center (8) to the service suppliers (A, B, . . . ); and instructing the service suppliers (A, B, . . . ) to take measures based on the transmitted information.

2. The method for servicing and maintaining heat supply equipment as defined in claim 1, therein there are provided a plurality of the maintenance object units, and the service suppliers (A, B, . . . ) are set for each of the maintenance object units.

* * * * *